United States Patent [19]

Wright

[11] Patent Number: 4,972,633

[45] Date of Patent: Nov. 27, 1990

[54] CORNER-MOUNTED SHIELD

[76] Inventor: Darrow D. Wright, 6926 Lehring Rd., Bancroft, Mich. 48414

[21] Appl. No.: 371,204

[22] Filed: Jun. 26, 1989

[51] Int. Cl.[5] ..... E04F 19/04

[52] U.S. Cl. ..... 52/27; 358/108; 248/220.1; 248/466; 52/288

[58] Field of Search ..... 52/288, 27, 28, 39; 40/646; 248/220.1, 475.1, 466; 312/238; 358/108, 229; 354/81, 293; 352/242, 243

[56] References Cited

U.S. PATENT DOCUMENTS

| | | | |
|---|---|---|---|
| 2,337,213 | 12/1943 | Topping, Jr. | 181/31 |
| 2,819,139 | 1/1958 | Stevenson | 312/234 |
| 2,991,577 | 7/1961 | Bellochio | 248/466 |
| 4,160,999 | 7/1979 | Claggett | 358/108 |
| 4,536,995 | 8/1985 | Frederick | 403/403 X |
| 4,751,885 | 6/1988 | Squire | 312/238 X |
| 4,764,008 | 8/1988 | Wren | 358/108 X |

*Primary Examiner*—John E. Murtagh
*Assistant Examiner*—Jerrold D. Johnson
*Attorney, Agent, or Firm*—Krass & Young

[57] ABSTRACT

A corner-mounted shield for protecting monitoring devices includes a triangular protective plate attached to three adjacent corner-forming interior room surfaces (e.g. two walls and ceiling). Attachments to the corner-forming interior room surfaces are made behind the protective plate, usually through an opening in the protective plate, and are inaccessible after the opening is covered by a window. The window is attached to the protective plate with tamper-resistant fasteners and is essentially transparent to whatever is being monitored by the monitoring device. The monitoring device, mounted behind the protective plate and window, has a clear view of the monitored room through the window because the protective plate faces into and is within the monitored room.

23 Claims, 3 Drawing Sheets

CORNER-MOUNTED SHIELD

FIELD OF THE INVENTION

This invention relates to shields used to protect room or area monitoring devices.

BACKGROUND OF THE INVENTION

Protection of devices used to monitor rooms or areas, such as jail cells or lobbies, has been effected by either building a viewing port into a wall so the monitoring device may view the room or area through the viewing port, or by mounting the monitoring device outside the room so the monitoring device may view the room through gaps in a barrier, such as cell bars.

Building a viewing port into the wall of a room when the room is being constructed requires providing a tamper-resistant protective housing for the monitoring device outside of the room to be monitored. The associated monitoring device must be located inside the protective housing, which is behind the wall. Thus the monitoring device is unlikely to have a clear view of the entire room because room areas adjacent to the wall (through which the viewing port is mounted) tend to be behind the view of the monitoring device.

Refitting a viewing port into a constructed room includes the problem of making a hole of significant size in an existing room wall and fitting it with a viewing port. It also involves the task of finding a tamper-resistant secure place, outside of the monitored room, to mount the monitoring device.

The scheme of mounting the monitoring device outside the room, so it has a view of the inside of the room through gaps in a barrier, such as the bars of a cell, is often a viable alternative to use with rooms already constructed. Even so, the view of the room provided to the monitoring device is impaired as portions of a room most distant from the monitoring device tend to be occluded and inevitably blind spots occur both because of the barrier in front of the monitoring device and because the monitoring device is partially blocked by the wall in front of it.

In the cases noted above, the task of finding a place for the monitoring device may prove insurmountable as suitable places may not exist outside the room to be monitored. In the above cases, the monitoring device must be protected from tampering both from within and from without the monitored room, and thus the monitoring device must be mounted inside an armored, tamper-resistant housing with a transparent tamper-resistant viewing port. Because of the wide variety of places where such housings are to be placed, little standardization of housings is possible. At present, protection of monitoring devices, if a location to place a monitoring device can be found, requires substantial construction and results in limited performance.

The new corner-mounted shield overcomes the above limitations as:

it is straightforward to add during room construction or to add to already constructed rooms because it is pre-manufactured as a standard item and is placed in an available room corner using conventional fasteners;

it provides the monitoring device a view of the entire room because of the unobstructed view resulting from the viewing port facing into the room from a corner and because the internally located monitoring device is capable of being closer than an externally located monitoring device to the most distant part of the room; and it is inherently resistive to tampering because the wall attaching fasteners are inaccessible and the window attaching fasteners are tamper resistant.

SUMMARY OF THE INVENTION

It is the object of this invention to provide a novel way to protect monitoring devices, such as those used in jails, prisons, environmentally hazardous areas, or lobbies, with an attractive, easily installed, tamper resistant, corner-mounted shield that provides the monitoring device with a clear view of the area to be monitored.

A BRIEF DESCRIPTION OF THE DRAWINGS

One will better understand the present invention by referring to the following detailed description while consulting the accompanying drawings, where the same reference numerals are used to refer to the same parts throughout the several views, and in which.

DETAILED DESCRIPTION OF THE PREFERRED EMBODIMENT OF THE PRESENT INVENTION

Figure 1:
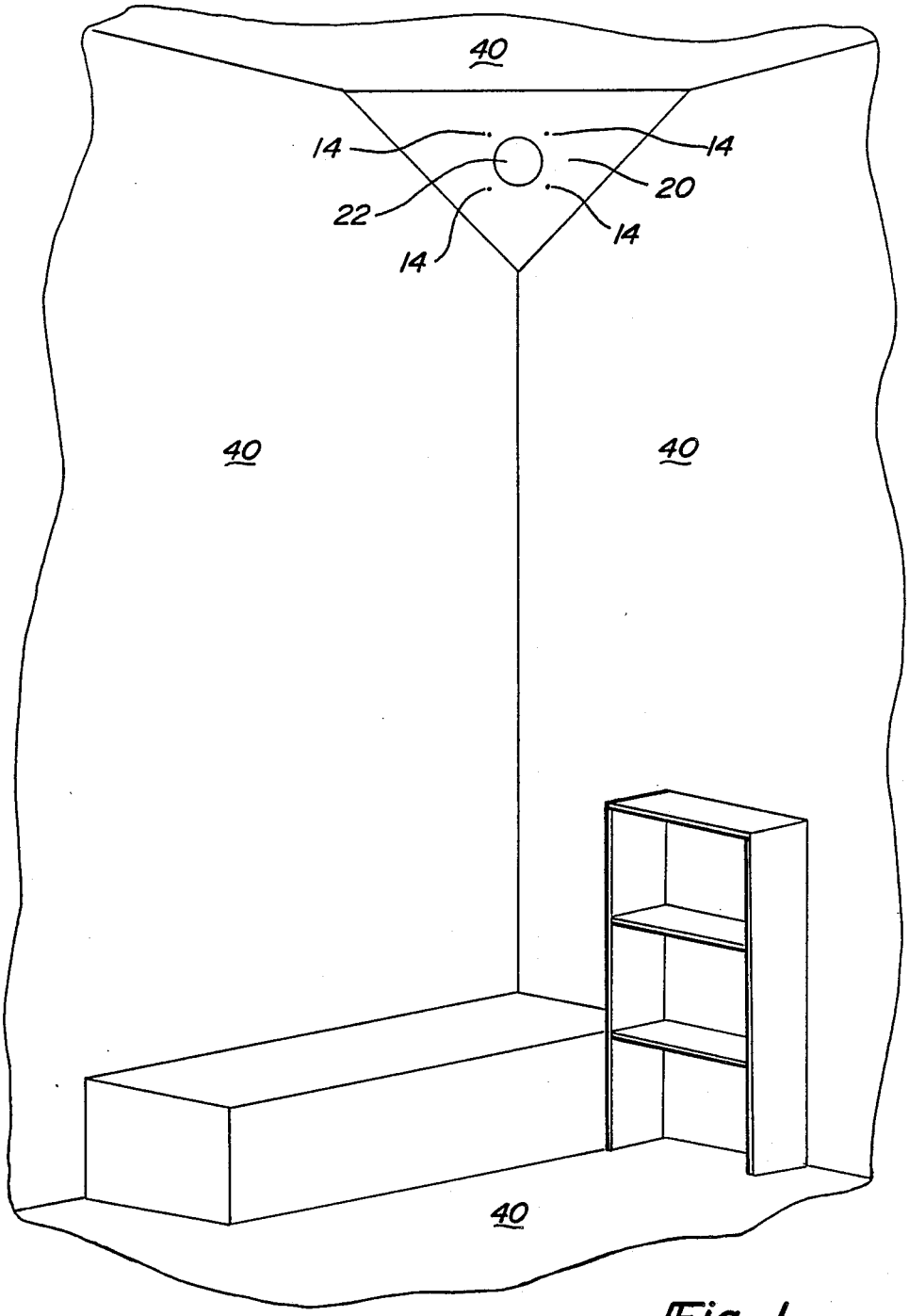
FIG. 1 is a perspective view of the corner-mounted shield as seen by an observer within the room monitored.

A person inside of a room being monitored would have a view of the shield much like that provided by FIG. 1. Such a person would see a triangular protective plate 20 flush mounted in a room corner formed by three adjacent interior room surfaces 40 and a window 10 flush mounted behind an opening 22 in the protective plate 20. The only visible or accessible fasteners are tamper-resistant fasteners 14 disposed about the opening 22 and used to attach the window 10 to the protective plate 20. Behind the window 10, a monitoring device 30 is placed so it may view the room.

Figure 2:
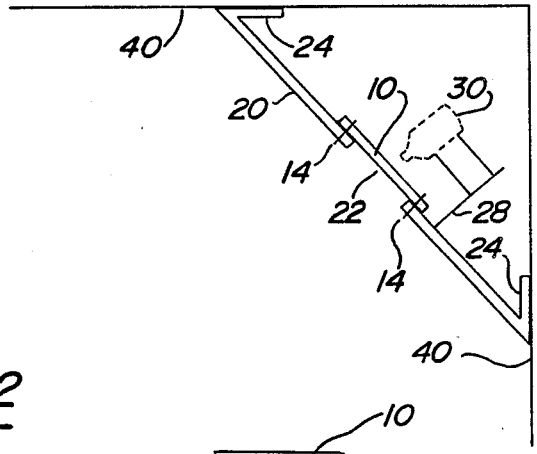
FIG. 2 is a cross section view of the corner-mounted shield showing a monitoring device looking through the window, and the protective plate's attachment to interior room surfaces.

FIG. 2 shows, in a side view of the shield, how most of the shield's components are arranged when it is mounted in a room corner formed by three adjacent interior room surfaces 40. The shield is composed of two main parts, a protective plate 20 and a window 10. The protective plate 20 is triangular, has a centrally located opening 22, holding channels 16 (not visible on FIG. 2), mounting brackets 24, apertures for fasteners 26 (not visible on FIG. 2), and a platform 28 for supporting a monitoring device 30. The window 10 is essentially transparent to whatever is monitored by the monitoring device 30 and has fastener attachment sites 12 (not visible on FIG. 2) for the tamper-resistant fasteners 14. The mounting brackets 24 are attached to the interior room surfaces 40 thereby affixing the protective plate 20. The window 10 is attached to the back of the protective plate 20 with tamper-resistant fasteners 14 passing through apertures for fasteners 26 into fastener attachment sites 12. A monitoring device 30 is attached to the platform 28 and may face directly, and without obstruction, through window 10 into the monitored room.

Figure 3:
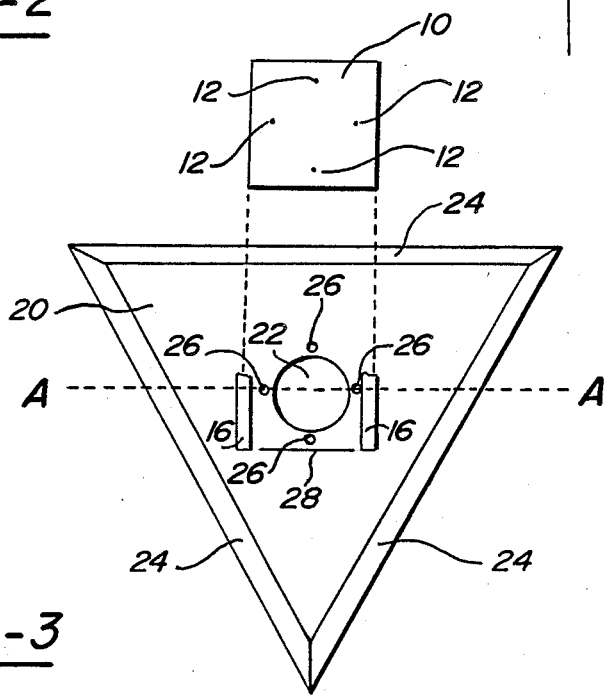
FIG. 3 is a rear view of the protective plate and detached window with dashed lines showing where the window is placed.
Figure 3A:
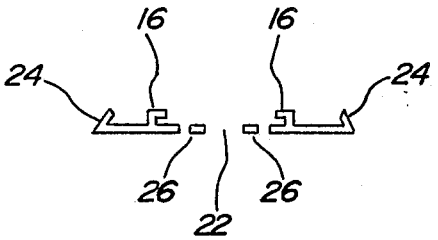
FIG. 3A is a cross section view through line A—A of FIG. 3.
Figure 4A:
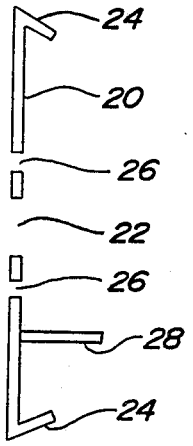
FIG. 4A is a side cross section view of the protective plate showing the inclination of rigidly attached mounting brackets, opening, apertures for fasteners used to attach the window, and the platform.
Figure 5:
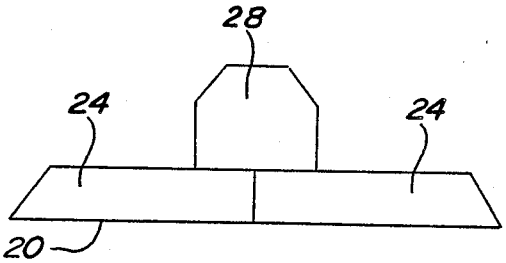
FIG. 5 is a bottom view of the protective plate showing the mounting brackets and platform.

FIG. 3 shows, in a rear view of the shield, how the shield's main parts are arranged and shows the components previously not shown. The fastener attachment sites 12 on the window 10 and the apertures for fasteners 26 on the protective plate 20 are arranged so they are aligned with each other when the window 10 is to be attached to the protective plate 20. The attachment is effected by passing a tamper-resistant fastener 14 (not shown in FIG. 3) through each aperture for fastener 26 to a fastener attachment site 12. The holding channels 16 are deployed on each side of the opening 22 and, along with the platform 28, serve to hold the window 10. The holding is especially useful while the window 10 is being attached. The cross section view of FIG. 3A shows the shape and placement of the holding channels 16, apertures for fasteners 26, opening 22, and mounting brackets 24 on the protective plate 20. In the preferred embodiment, the protective plate 20 is made of metal, and, as shown on FIG. 4A, the mounting brackets 24 are rigidly attached to the protective plate 20 and so inclined as to be flush with the interior room surfaces 40 when the shield is placed in a corner. The platform 28 is attached below the opening 22 essentially perpendicular to the protective plate 20 and, as shown on FIG. 5, extends far enough so as to furnish a convenient support for a monitoring device 30. The window 10, for optical monitoring, is made of the clear polycarbonate resin material sold by General Electric under the trademark "LEXAN" because of its excellent transparency to white light, high impact resistance relative to glass, hardness, and resistance to scratching. The fastener attachment sites 12 on the window 10 align with the apertures for fasteners 26 in the protective plate 20 when the window 10 is attached to the protective plate 20 with the tamper-resistant fasteners 14, and the fastener attachment sites 12 are appropriate for the particular tamper-resistant fasteners 14 used. The tamper-resistant fasteners 14 may include conventional bolts or screws with their heads ground down after use, rivets, or bolts or screws with their engaging surfaces filled or covered with solder after use.

The shield is mounted by:

placing the window 10 loosely behind the protective plate 20 anywhere where it may be reached through the opening 22 and where it does not interfere or, alternatively, by placing the window 10 loosely between the holding channels 16 and platform 28;

placing the protective plate 20 plus loose window 10 against three interior room surfaces 40 so the mounting brackets 24 are flush to each interior room surface 40; and attaching the mounting brackets 24 to the interior room surfaces 40 with conventional fastening methods, such as by welding, bolting, or gluing, where such methods may be made effective through the opening 22.

A monitoring device 30, such as a television camera, is placed on the platform 28 so as to be able to view the room through the opening 22. The hitherto loose window 10 is positioned between the opening 22 and the monitoring device 30 flush against the protective plate 20 with each fastener attachment site 12 aligned with each aperture for fastener 26. Then the window 10 is attached using tamper-resistant fasteners 14 passing through each aperture for fastener 26 to a fastener attachment site 12.

Figure 4B:
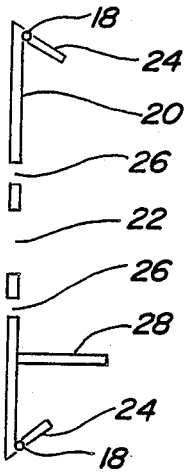
FIG. 4B is the same as FIG. 4A where the mounting brackets are flexibly attached with hinges.

An alternative embodiment may be effected by flexibly attaching the mounting brackets 24 to the protective plate 20, as with hinges 18. This alternative is indicated on FIG. 4B, and is appropriate when the three corner-forming interior room surfaces 40 are not mutually orthogonal or it is desired to skew the view through the window 10 provided to the monitoring device 30.

The shield of the present invention is advantageous in a number of different respects.

First, the monitoring device 30 is effectively shield from tampering because the fasteners used to attach the mounting brackets 24 to three corner-forming interior room surfaces 40 are behind the protective plate 20 and thus inaccessible, and because the fasteners used to attach the window 10 to the protective plate 20 are tamper resistant.

The present invention is further advantageous because the shield may be refitted into a room or cell merely by providing communication to the monitoring device 30, most often through a small opening, and attaching the protective plate's mounting brackets 24 to three corner-forming interior surfaces 40. These operations may be performed at low cost using simple tools, even if the walls are made of concrete or masonry. The shield may also be placed in a room during the room's construction with equal ease. The ease of use of the present invention may be contrasted with the alternatives:

The first alternative to the use of this invention requires making a hole in a wall large enough for a viewing port and providing a secure place behind the wall for the monitoring device 30.

The second alternative is to place the monitoring device 30 so it views the room through a barrier, such as cell bars, while being enclosed in a secure housing.

Both of the alternatives require more effort and cost to implement than does the present invention.

A further advantage of the present invention is its ability to provide a clear view of the inside of the monitored room. This is because the protective plate 20, and thus the monitoring device 30, faces into, and is within, the monitored room. Thus all of the room is normally well within the view of the monitoring device 30. In the first alternative to the present invention, described above, it is inherently difficult to place the viewing port so as to provide a clear view of the entire room because areas to the side of the wall-mounted viewing port tend to be behind the view of the monitoring device. The second alternative, described above, also has the problem of some of the room being behind the view of the monitoring device and has some additional blockage due to the intervening barrier. Neither of the alternatives provides as good a view as the present invention wherein essentially none of the room is to the side of the window 10 and there are no intervening barriers to the view of the monitoring device 30.

A still further advantage of the present invention is its pleasing and unobtrusive appearance. In areas such as lobbies, pleasing appearance is important. The shield as a whole is symmetrical, merges smoothly with the shape of the room, and can be painted to match its surroundings. These properties causes it to be inconspicuous or at least not unpleasant or annoying to an observer.

The present invention, even for new construction, provides a tamper resistant, less expensive, more efficacious, and pleasing solution to the need to protect monitoring devices 30. It is inherently difficult to tamper with, is straightforward to mount, allows a full view, and is easy on the eyes.

Although a preferred embodiment of the invention has been disclosed in detail, it will be recognized that variations or modifications lie within the scope of the present invention.

I claim:

1. A shield for mounting to corner-forming adjacent interior surfaces for protecting monitoring devices, comprising:

a triangular protective plate having attached mounting brackets and an opening;

first attaching means for attaching said mounting brackets to corner-forming adjacent interior surfaces;

means for supporting the monitoring device;

a window made of an essentially transparent material;

second attaching means for attaching said window to said protective plate with said window covering said opening.

2. A shield as recited in claim 1, wherein said protective plate is made of metal.

3. A shield as recited in claim 1, wherein said mounting brackets are flexibly attached to said protective plate.

4. A shield as recited in claim 3, wherein said shield further includes hinges for flexibly attaching said mounting brackets to said protective plate.

5. A shield as recited in claim 1, wherein said mounting are rigidly attached to said protective plate.

6. A shield as recited in claim 1, wherein said first attaching means are only accessible through said opening.

7. A shield for mounting to corner-forming adjacent interior surfaces for protecting monitoring devices, comprising:

a triangular protective plate having attached mounting brackets and a centrally located opening;

first attaching means for attaching said mounting brackets to corner-forming adjacent interior surfaces;

a window made of an essentially transparent material, said essentially transparent material being impact resistant and essentially transparent to whatever is monitored by the monitoring device; and second attaching means for attaching said window to said protective plate with said window covering said opening.

8. A shield as recited in claim 7, wherein said protective plate is made of metal.

9. A shield as recited in claim 7, wherein said mounting brackets are flexibly attached to said protective plate.

10. A shield as recited in claim 9, wherein said shield further includes hinges for flexibly attaching said mounting brackets to said protective plate.

11. A shield as recited in claim 7, wherein said mounting brackets are rigidly attached to said protective plate.

12. A shield as recited in claim 7, wherein said essentially transparent material includes polycarbonate resin. and essentially transparent to whatever is monitored by the monitoring device.

13. A shield as recited in claim 7, wherein said first attaching means are only accessible through said opening.

14. A shield as recited in claim 7, wherein said second attaching means includes tamper-resistant fasteners.

15. A shield for mounting to corner-forming adjacent interior surfaces for protecting monitoring devices, comprising:

a triangular protective plate having attached mounting brackets and a centrally located opening;

attaching means, only accessible through said opening, for attaching said mounting brackets to corner-forming adjacent interior surfaces;

a window made of an impact resistant material essentially transparent to whatever is monitored by the monitoring device; and tamper-resistant fasteners for attaching said window to said plate with said window covering said opening.

16. A shield as recited in claim 15, wherein said protective plate is made of metal.

17. A shield as recited in claim 15, wherein said mounting brackets are flexibly attached to said protective plate.

18. A shield as recited in claim 17, wherein said shield further includes hinges for flexibly attaching said mounting brackets to said protective plate.

19. A shield as recited in claim 15, wherein said mounting brackets are rigidly attached to said protective plate.

20. A shield as recited in claim 15, further including means for supporting the monitoring device.

21. A shield as recited in claim 15, wherein said impact resistant material includes polycarbonate resin.

22. A shield for mounting to corner-forming adjacent interior surfaces for protecting monitoring devices, comprising:

a monitoring device;

a triangular protective plate having attached mounting brackets and an opening;

first attaching means for attaching said mounting brackets to corner-forming adjacent interior surfaces;

a window made of an essentially transparent material; and second attaching means for attaching said window to said protective plate with said window covering said opening.

23. A shield for mounting to corner-forming adjacent interior surfaces for protecting monitoring devices, comprising:

a triangular protective plate having attached mounting brackets and an opening, said triangular protective plate being made of an inflexible one piece, metal plate;

first attaching means for attaching said mounting brackets to corner-forming adjacent interior surfaces;

a window made of an essentially transparent material; and second attaching means for attaching said window to said protective plate with said window covering said opening.

* * * * *

UNITED STATES PATENT AND TRADEMARK OFFICE

CERTIFICATE OF CORRECTION

PATENT NO. : 4,972,633

DATED : November 27, 1990

INVENTOR(S) : Wright

It is certified that error appears in the above-identified patent and that said Letters Patent is hereby corrected as shown below:

Column 4, line 18, "shield" should be --shielded--;

Column 5, line 26, ";" should be --; and--;

Column 6, line 3, delete "and essentially transparent to whatever is monitored by";

Column 6, line 4, delete "the monitoring device.".

Signed and Sealed this

Thirty-first Day of March, 1992

*Attest:*

HARRY F. MANBECK, JR.

*Attesting Officer*

*Commissioner of Patents and Trademarks*